US006605356B2

(12) United States Patent
Ouchi et al.

(10) Patent No.: US 6,605,356 B2
(45) Date of Patent: Aug. 12, 2003

(54) METAL SURFACE TREATMENT AGENT, AND METAL MATERIAL COATED WITH SAME

(75) Inventors: Takashi Ouchi, Kitaibaraki (JP); Katsuyuki Tsuchida, Kitaibaraki (JP); Masashi Kumagai, Hitachi (JP)

(73) Assignee: Nikko Materials Co., Ltd., Tokyo (JP)

( * ) Notice: Subject to any disclaimer, the term of this patent is extended or adjusted under 35 U.S.C. 154(b) by 0 days.

(21) Appl. No.: 10/009,902

(22) PCT Filed: Aug. 27, 2001

(86) PCT No.: PCT/JP01/07311

§ 371 (c)(1), (2), (4) Date: Dec. 10, 2001

(87) PCT Pub. No.: WO02/42520

PCT Pub. Date: May 30, 2002

(65) Prior Publication Data

US 2003/0054174 A1 Mar. 20, 2003

(30) Foreign Application Priority Data

Nov. 24, 2000 (JP) ..... 2000-357097

(51) Int. Cl.[7] ..... B32B 27/38

(52) U.S. Cl. ..... 428/418; 428/447; 428/413; 428/414; 528/25; 528/44; 528/370; 528/371

(58) Field of Search ..... 428/413, 418, 428/447; 528/25, 44, 370, 371; 525/477, 6

(56) References Cited

FOREIGN PATENT DOCUMENTS

| | | |
|---|---|---|
| JP | 8-252522 | 10/1996 |
| JP | 9-3076 | 1/1997 |
| JP | 9-3077 | 1/1997 |
| JP | 2682168 | 8/1997 |

*Primary Examiner*—Robert Dawson
*Assistant Examiner*—Christopher M Keehan
(74) *Attorney, Agent, or Firm*—Flynn, Thiel, Boutell & Tanis, P.C.

(57) ABSTRACT

A metal surface treatment agent containing the following components (A) to (D), which securely adheres to a metal substrate such as aluminum, exhibits excellent corrosion preventive properties, even with a thin film thickness, and has excellent plasticity and adhesion to paints.

(A) at least one organosilicon compound having three carbonyl groups and at least one alkoxysilyl group, the organosilicon compound being present in a weight ratio of 5 to 15, based on the total of the components (A) to (D) being 100;

(B) at least one epoxy resin modified with an alkanolamine, the modified epoxy resin being present in a weight ratio of 10 to 30 relative to the above total;

(C) at least one blocked polyisocyanate present in a weight ratio of 50 to 70 relative to the above total; and (D) at least one amino resin present in a weight ratio of ratio 5 to 15 relative to the above total.

6 Claims, No Drawings

METAL SURFACE TREATMENT AGENT, AND METAL MATERIAL COATED WITH SAME

TECHNICAL FIELD

This invention relates to a metal surface treatment agent that is used to prevent the corrosion of a metal and improve the adhesion between a metal and a paint, and to a substrate that has been surface treated with this agent, and can be applied in a variety of industrial fields that make use of metal products, such as construction materials, electrical equipment, machinery, and automobiles.

BACKGROUND ART

Corrosion prevention treatments with numerous inorganic materials, metals, and organic materials have been performed in the past in an effort to protect metal surfaces from various corrosive environments. Many different corrosion preventive agents have been used up to now, including water-soluble corrosion preventive agents, vaporizable corrosion preventive agents, and oil-based corrosion preventive agents. Water-soluble corrosion preventive agents are generally intended for temporary, shortterm use, and are not used for extended periods. Vaporizable corrosion preventive agents exhibit their inherent corrosion preventive effects in a closed environment. Oil-based corrosion preventive agents offer relatively strong corrosion preventive effects and can stand up to prolonged use, and come as liquid corrosion preventive oil, sticky corrosion preventive grease, and solutions produced by dissolving corrosion preventive additives or film-forming agents in an organic solvent. However, the liquid corrosion preventive oil and corrosion preventive grease cannot be used as primers for paints and so forth because they leave the surface tacky after treatment. Also, the film thickness has to be increased for adequate corrosion preventive performance to be realized. Japanese patent 2,682,168 discusses an alternative to such materials, which is a combination of an organosilicon compound and an epoxy resin having hydroxyl groups. While this material does indeed provide an excellent corrosion preventive effect through a curing reaction, the film needs to be at least 10 microns thick for the corrosion preventive effect to be realized.

Aluminum and aluminum alloys find use in many different applications because of their light weight. However, since they have an aluminum oxide film on the surface thereof, paint does not adhere well when applied directly thereto. Many chemical conversion treatments have been proposed for a paint primary coating or undercoating, and numerous patent applications have been filed before, but the chromate process is the most prevalent today. A chromate treatment, however, is undesirable from the standpoint of the environment, making non-chromate treatments more attractive. A method involving treatment with an alkali metal aqueous solution has also been proposed in an effort to impart corrosion resistance, antistatic properties, and so forth to a metal surface, but obtaining the desired characteristics requires immersion in boiling water or an acid as an after-treatment.

The present invention provides a metal surface treatment agent that satisfies these requirements, that is, one that securely adheres to metal articles such as aluminum and aluminum alloys, exhibits an excellent corrosion preventive effect even with a thin film thickness, and has an excellent plasticity and adhesion to paints, and provides a metal material that has been surface treated with this agent.

DISCLOSURE OF THE INVENTION

As a result of diligent investigation, the inventors arrived at the present invention upon discovering that a composition comprising an organosilicon compound having three carbonyl groups and an alkoxysilyl group, an epoxy resin modified with an alkanolamine, a blocked polyisocyanate, and an amino resin exhibits excellent corrosion prevention properties and paint adhesion when used on metals.

Specifically, the present invention relates to:

(1) a metal surface treatment agent, comprising the following components (A) to (D):
- (A) at least one organosilicon compound having three carbonyl groups and at least one alkoxysilyl group, in a weight ratio of 5 to 15 when the total of the components (A) to (D) is 100;
- (B) at least one epoxy resin modified with an alkanolamine, in a weight ratio of 10 to 30 relative to the above total;
- (C) at least one blocked polyisocyanate, in a weight ratio of 50 to 70 relative to the above total; and
- (D) at least one amino resin in a weight ratio of 5 to 15 relative to the above total, (2) the metal surface treatment agent according to (1) above, wherein the (A) organosilicon compound having three carbonyl groups and at least one alkoxysilyl group is represented by the following general formula (1):

(1)

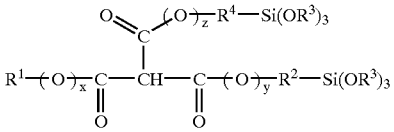

[where said compound includes an enol form compound that is a tautomer; in general formula (1), $R^1$ and $R^3$ are $C_1$ to $C_5$ alkyl groups, $R^2$ and $R^4$ are $C_2$ to $C_{10}$ alkylene groups, and x, y, and z are each 0 or 1], (3) the metal surface treatment agent according to (1) above, wherein the epoxy resin in the (B) epoxy resin modified with an alkanolamine is a bisphenol-based epoxy resin.

(4) the metal surface treatment agent according to (1) above, wherein the (C) blocked polyisocyanate is represented by the following general formulas (2) and/or (3):

(2)

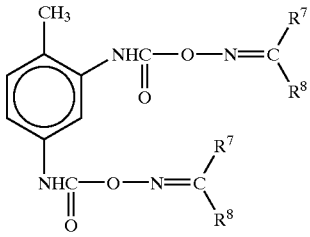

-continued (3)

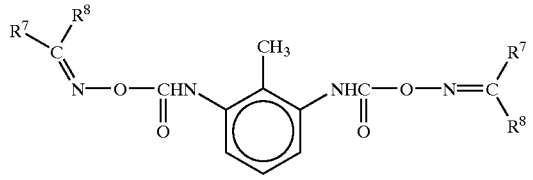

[where $R^7$ and $R^8$ in general formulas (2) and (3) are $C_1$ to $C_5$ alkyl groups], (5) the metal surface treatment agent according to (1) above, wherein the (D) amino resin is a melamine resin, and (6) a metal material having a film formed by coating with the metal surface treatment agent according to any of (1) to (5) above, the film having a corrosion resistance, paint film adhesion, excellent plasticity and high surface hardness.

BEST MODE FOR CARRYING OUT THE INVENTION

The organosilicon compound having three carbonyl groups and at least one alkoxysilyl group used in the present invention (hereinafter abbreviated as a tricarbonyl compound) has been disclosed along with a method for synthesizing this compound in Japanese Patent Application Laid-Open Nos. H9-3076 and 3077, and this disclosed compound can be used favorably.

The alkanolamine in the epoxy resin modified with an alkanolamine used in the present invention (hereinafter abbreviated as a modified epoxy resin) can be an alkanolamine having primary or secondary amino groups capable of undergoing an addition reaction with the epoxy groups of the epoxy resin, and diethanolamine can be used to particular advantage.

Examples of the epoxy resin in the epoxy resin modified with an alkanolamine used in the present invention include bisphenol A and F epoxy resins based on bisphenol A. Other examples include brominated epoxy resins obtained by substituting some of the hydrogens in the benzene rings of a bisphenol A-based epoxy resin with bromine, dimeric acid-based glycidyl ester epoxy resins, phenoxy resins, glycidylamine epoxy resins, novolac epoxy resins, glycidyl ester epoxy resins, biphenyl epoxy resins, and cycloaliphatic epoxy resins.

Examples of the blocked polyisocyanate used in the present invention (hereinafter abbreviated as a blocked isocyanate) include those obtained by reacting tolylene diisocyanate, 4,4'-diphenylmethane diisocyanate, xylylene diisocyanate, hexamethylene diisocyanate, 2,6-diisocyanate methyl caproate, 4,4'-methylenebis (cyclohexyl isocyanate), methylcyclohexane-2,4-(2,6) diisocyanate, 1,3-(isocyanate methyl) cyclohexane, isophorone diisocyanate, trimethylhexane diisocyanate, or dimeric acid diisocyanate with a blocking agent such as phenol-, lactam-, active methylene-, acid amide-, imide, amine, imidazole-, urea-, imine, or oxime-based blocking agent in accordance with a customarily used method. Phenol-, lactam-, acid amide-, active methylene-, and oxime-based blocking agents are preferred, and an oxime-based blocking agent is Particularly favorable. Examples of oxime-based blocking agents include formaldoxime, acetaldoxime, methyl ethyl ketoxime, and cyclohexanone oxime.

Examples of the amino resin used in the present invention include butylated urea resins, butylated melamine resins, methylated melamine resins, and butylated benzoguanamine resins, but a methylated melamine resin is particularly favorable.

The weight ratios of the components in the present invention should be such that if we let the combined total of the components (A) to (D) be 100, the ratio of the tricarbonyl compound of component (A) is 5 to 15, that of the modified epoxy resin of component (B) is 10 to 30, that of the blocked isocyanate of component (C) is 50 to 70, and that of the amino resin of component (D) is 5 to 15. If the weight ratio of the tricarbonyl compound is less than 5, the film formed from the surface treatment agent will have lower corrosion resistance and plasticity. If the ratio is over 15, the plasticity and acid resistance will decrease. If the weight ratio of the modified epoxy resin is outside the range of 10 to 30, there will be a remarkable drop in the corrosion resistance, paint adhesion, plasticity, and acid resistance of the formed film. If the weight ratio of the blocked isocyanate is outside the range of 50 to 70, there will be marked decreases in the corrosion resistance, paint adhesion, plasticity, and acid resistance of the formed film. The decrease in plasticity will be particularly pronounced. The film will also have less plasticity and acid resistance if the weight ratio of the amino resin is outside the range of 5 to 15.

It is preferable in the present invention to use an organic solvent to uniformly coat a substrate with the above-mentioned composition. Examples of organic solvents include toluene, xylene and other aromatic-type solvents; methoxyethanol, ethoxyethanol, and other cellosolve-type solvents; methylpropylene glycol, propylpropylene glycol, and other glycol ether-type solvents; acetone, methyl ethyl ketone, and other ketone solvents; ethyl acetate and other ester-type solvents; and methanol, isopropyl alcohol, and other alcohol-type solvents. If needed, a viscosity regulator, anti-foaming agent, UV absorbent, surfactant, or the like may also be added.

The metal surface treatment agent of the present invention is used on metal substrates. This metal substrate can be made of aluminum, zinc, magnesium, iron, and so on, or alloys of these. The metal surface treatment agent exhibits particularly good corrosion preventive performance on aluminum and aluminum alloys. The metal surface treatment agent of the present invention is preferably used in diluted form, with an organic solvent accounting for 50 to 99 wt % with respect to the total solids consisting of components (A) to (D). Any known coating method can be employed, such as spray coating, dip coating, brush coating, or roll coating.

For the effects of the present invention to be fully realized, it is preferable for the coating film to be heat-dried after application. This is preferably accomplished by drying at 100 to 300° C. for between 5 seconds and 60 minutes. A uniform coating film is formed and the object of the present invention can be achieved by removing the solvent and conducting a curing reaction under heating conditions after application. The thickness of this coating film is preferably 0.1 to 100 $\mu$m. A range of 0.3 to 3 $\mu$m is even better. An adequate corrosion preventive effect will not be imparted below 0.1 $\mu$m, but there will be a decrease in adhesion to the topcoat if the film thickness exceeds 100 $\mu$m.

The film of a surface treatment agent formed as above can be coated with the desired paint as required. There are no particular restrictions on this paint, and any paint commonly used on metal substrates can be used.

EXAMPLES

Examples of the present invention will now be contrasted with comparative examples.

(A) Synthesis of Tricarbonyl Compound

A tricarbonyl compound [$R^1$ in general formula (1) is a methyl group, $R^2$ is an n-propylene group, $R^3$ is a methyl group, $R^4$ is an n-undecylene group, x is 0, y is 1, and z is 0] was synthesized according to the working example in Japanese Patent Application Laid-Open No. H9-3077.

(B) Synthesis of modified epoxy resin 150 g of a bisphenol A-based epoxy resin [Epikote 1007 (molecular weight approximately 2900) made by Yuka Shell Epoxy]and 150 g of propyl propylene glycol were put in a three-neck flask and formed into a uniform solution at 150° C. under a nitrogen atmosphere. 10.8 g of diethanolamine was dissolved in 10.8 g of propyl propylene glycol and added dropwise to the above solution over a period of 30 minutes. Upon completion of the addition, the reaction was allowed to continue for 1 hour at 150° C., which yielded a diethanolamine-modified epoxy resin. The completion of the reaction was confirmed by GPC (gel permeation chromatography).

Tolylene diisocyanate (mixture of 2,6- and 2,4-isomers) was reacted with methyl ethyl ketoxime by a conventional method to synthesize a blocked isocyanate. The completion of the reaction was confirmed by FTIR.

(D) Amino Resin

A commercially available amino resin was used (Sumimal M-40ST, made by Sumitomo Chemical)

Example 1

The respective components mentioned above were weighed out in such amounts that the components (A) to (D) were combined in the ratios given in Table 1 below. Each composition was then diluted with and dissolved in methyl propylene glycol such that the solids content would be 5 wt %, and the resulting solution was used to coat an aluminum substrate (A1050P, 55×55×0.6) by spin coating. The resultant product was then treated for 10 minutes at 220° C. to obtain a test substrate. The thickness of the surface treatment film after drying was approximately 0.5 μm. This test substrate was evaluated as follows.

Salt Spray Test

Each of the test substrates in this Example was subjected to the salt spray test outlined in JIS-Z-2371. The test time was 168 hours.

Paint Film Test

The surface treatment film on each test substrate in this Example was coated with a polyester paint by spin coating. A heat treatment was then conducted for 5 minutes at 245° C. The thickness of the polyester paint film was approximately 15 μm. Each test substrate was then used to test the following properties.

(1) Paint Film Adhesion

Each test substrate was immersed in boiling water for 5 hours, after which the cross-cut tape peeling test outlined in JIS-K-5400 was conducted.

(2) Plasticity

Using the flex tester specified in JIS-K-5400, each test substrate was bent to the 180° mark at a mandrel diameter of 3 mm and a backing plate thickness of 3.5 mm, after which it was immersed in boiling water for 5 hours and the bent portion was examined visually.

(3) Acid Resistance

Cross-cuts were made with a cutter near the center of each test substrate, and each test substrate was immersed for 24 hours in a 5 w/v % sulfuric acid solution, after which a tape peeling test was performed on the cross-cut portion.

The results of the above tests are given in Table 1.

Comparative Example 1

The components (A) to (D) were combined in the blending ratios given in Table 2 below, and diluted with methyl propylene glycol so that the solids content would be 5%. Each solution was used to coat an aluminum substrate and then treated in the same manner as in Example 1 to produce a test substrate. Each test substrate was evaluated in the same manner as in Example 1. Separately, a substrate that had undergone the same chemical conversion treatment as the products currently available from aluminum manufacturers (an aluminum substrate was treated with a phosphoric acid chromate as an undercoat, and coated with an epoxy resin-based primer and a polyester resin-based top coat; the thickness of the primer film was approximately 5 μm, and the thickness of the top coat was approximately 15 μm) and an aluminum substrate that had undergone the above-mentioned primer and top coat treatments directly without being treated with the phosphoric acid chromate undercoat were obtained and subjected to the above tests. These results are also given in Table 2.

TABLE 1

| | Mass ratio of components | | | | Test results | | | |
|---|---|---|---|---|---|---|---|---|
| No. | (A) | (B) | (C) | (D) | Salt spray | Paint film adhesion | Plasticity | Acid resistance |
| 1 | 10 | 20 | 60 | 10 | ○ | ○ | ○ | ○ |
| 2 | 10 | 10 | 60 | 10 | ○ | ○ | ○ | ○ |
| 3 | 10 | 30 | 60 | 10 | ○ | ○ | ○ | ○ |
| 4 | 10 | 20 | 50 | 10 | ○ | ○ | ○ | ○ |
| 5 | 10 | 20 | 70 | 10 | ○ | ○ | ○ | ○ |
| 6 | 10 | 20 | 60 | 5 | ○ | ○ | ○ | ○ |
| 7 | 10 | 20 | 60 | 15 | ○ | ○ | ○ | ○ |
| 8 | 5 | 20 | 60 | 10 | ○ | ○ | ○ | ○ |
| 9 | 15 | 20 | 60 | 10 | ○ | ○ | ○ | ○ |

TABLE 2

| | Mass ratio of components | | | | Test results | | | |
|---|---|---|---|---|---|---|---|---|
| No. | (A) | (B) | (C) | (D) | Salt spray | Paint film adhesion | Plasticity | Acid resistance |
| 1 | 10 | 5 | 60 | 10 | x | x | x | x |
| 2 | 10 | 40 | 60 | 10 | Δ | x | x | x |
| 3 | 10 | 20 | 35 | 10 | Δ | Δ | x | Δ |
| 4 | 10 | 20 | 95 | 10 | Δ | Δ | x | Δ |
| 5 | 10 | 20 | 60 | 0 | ○ | ○ | Δ | Δ |
| 6 | 10 | 20 | 60 | 20 | ○ | ○ | Δ | Δ |
| 7 | 0 | 20 | 60 | 10 | Δ | ○ | Δ | ○ |
| 8 | 20 | 20 | 60 | 10 | ○ | ○ | Δ | Δ |
| 9 | no chemical conversion | | | | x | x | x | x |
| 10 | Chemical conversion (phosphoric acid chromate) | | | | Δ | ○ | Δ | ○ |

Note: The evaluation criteria in the tests were as follows.

(1) Salt spray

○: almost no corrosion

Δ: pitting seen in places x: entire surface corroded (2) Paint film adhesion

○: no peeling

Δ: slight peeling noted at the cross-cut intersections x: entire surface peeled (3) Plasticity ○: no cracking at the bent portion Δ: slight cracking noted at the bent portion x: paint film peeled from the bent portion (4) Acid resistance ○: no peeling Δ: slight peeling noted at the cross-cut intersections x: entire surface peeled

Example 2

The respective components were weighed out in the amounts specified in Nos. 1 to 9 in Example 1, then diluted with and dissolved in methyl propylene glycol such that the solids content would be 25 wt %, and the resulting solution was used to coat a zinc plated steel sheet (Zincoat Non-Chromate, made by Nippon Steel, 60×80×0.6) by spin coating. Each product was then treated for 10 minutes at 220° C. to obtain a test substrate. Each test substrate was subjected to the pencil scratch test outlined in JIS-K-5400. The results for all test substrates showed a hardness, in terms of pencil hardness, of at least 5H. The film thickness on the test substrate was approximately 3 μm.

Example 3

The components were weighed out in the amounts specified in No. 1 in Example 1, then diluted with and dissolved in methyl propylene glycol such that the solids content would be 20 wt %, and the resulting solution was used to coat a magnesium substrate (AZ31, 40×30×1.5) by dip coating. This product was then treated for 10 minutes at 220° C. This substrate was sprayed with an enamel paint to produce a test substrate. Cross-cuts were made with a cutter near the center of this test substrate, and a CASS test was conducted according to JIS-H-8681-2. The test time was 48 hours. The thickness of the surface treatment film of the test substrate was approximately 2 μm, and the thickness of the enamel paint film was approximately 15 μm.

Comparative Examples 2 and 3

A magnesium substrate (AZ31, 40×30×1.5) was sprayed with an enamel paint to form a paint film approximately 15 μm thick, and cross-cuts were made with a cutter near the center to obtain a test substrate (Comparative Example 2). Another test substrate consisted of an untreated magnesium substrate (Comparative Example 3). These were subjected to the CASS test outlined in JIS-H-8681-2. The test time was 48 hours.

The results are given in Table 3 along with those for Example 3.

TABLE 3

| | CASS test results |
|---|---|
| Example 3 | almost no corrosion |
| Comparative Example 2 | blistering at cross-cuts |
| Comparative Example 3 | entire surface corroded |

INDUSTRIAL APPLICABILITY

As described above, the surface treatment agent of the present invention securely adheres to metal surfaces, exhibits excellent corrosion preventive properties, even with a thin film thickness, and has excellent plasticity and adhesion to paint films formed on the film of the surface treatment agent.

What is claimed is:

1. A metal surface treatment agent, comprising the following components (A) to (D):

(A) at least one organosilicon compound having three carbonyl groups and at least one alkoxysilyl group, the organosilicon compound being present in a weight ratio of 5 to 15 based on the total of the components (A) to (D) being 100;

(B) at least one epoxy resin modified with an alkanolamine, the modified epoxy resin being present in a weight ratio of 10 to 30 relative to the above total;

(C) at least one blocked polyisocyanate present in a weight ratio of 50 to 70 relative to the above total; and (D) at least of one amino resin present in a weight ratio of 5 to 15 relative to the above total.

2. The metal surface treatment agent according to claim 1, wherein the (A) organosilicon compound having three carbonyl groups and at least one alkoxysilyl group is represented by the following general formula (1)

(1)

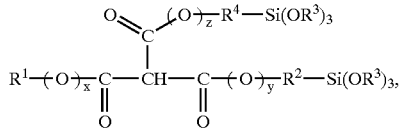

where said compound includes an enol form compound that is a tautomer; in general formula (1), $R^1$ and $R^3$ are $C_1$ to $C_5$ alkyl groups, $R^2$ and $R^4$ are $C_2$ to $C_{10}$ alkylene groups, and x, y, and z are each 0 or 1.

3. The metal surface treatment agent according to claim 1, wherein the epoxy resin in the (B) epoxy resin modified with an alkanolamine is a bisphenol-based epoxy resin.

4. The metal surface treatment agent according to claim 1, wherein the (C) blocked polyisocyanate is represented by the following general formulas (2) and/or (3)

(2)

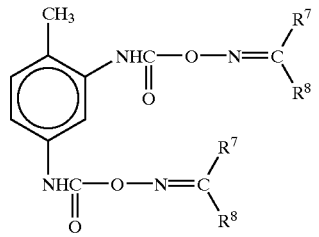

-continued (3)

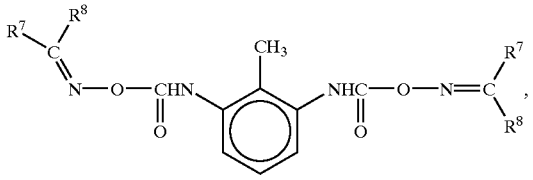

where $R^7$ and $R^8$ in general formulas (2) and (3) are $C_1$ to $C_5$ alkyl groups.

5. The metal surface treatment agent according to claim 1, wherein the (D) amino resin is a melamine resin.

6. A metal material having a film formed by coating with the metal surface treatment agent according to claim 1, the film having corrosion resistance, paint film adhesion, excellent plasticity and high surface hardness.

* * * * *